United States Patent [19]

Takahashi

[11] 4,331,180

[45] May 25, 1982

[54] APPARATUS FOR PRODUCING A WOVEN SLIDE FASTENER STRINGER

[75] Inventor: Kihei Takahashi, Uozu, Japan

[73] Assignee: Yoshida Kogyo K.K., Tokyo, Japan

[21] Appl. No.: 165,293

[22] Filed: Jul. 2, 1980

[30] Foreign Application Priority Data

Jul. 4, 1979 [JP] Japan ..... 54-84657

[51] Int. Cl.[3] ..... D03D 41/00

[52] U.S. Cl. ..... 139/35

[58] Field of Search ..... 139/11 R, 35, 116, 118, 139/384 B

[56] References Cited

U.S. PATENT DOCUMENTS 3,941,163 3/1976 Glindmeyer et al. ..... 139/384 B
4,174,736 11/1979 Takahashi et al. ..... 139/35
4,184,518 1/1980 Yoshida et al. ..... 139/35

*Primary Examiner*—Henry Jaudon

*Attorney, Agent, or Firm*—Hill, Van Santen, Steadman, Chiara & Simpson

[57] ABSTRACT

An apparatus for producing a woven slide fastener stringer includes a loom for weaving a stringer tape and a rotor assembly for coiling an element-forming monofilament around a mandrel to form a coiled coupling element, which is then woven into the stringer tape along a longitudinal edge thereof. The rotor assembly comprises a rotor rotatably mounted eccentrically on a stationary shaft, and having a guide hole for passage therethrough of the monofilament and a pin angularly spaced 180 degrees from the guide hole and slidably received in a radial slot in a radial arm to which there is drivingly connected a drive gear rotatably mounted on the stationary shaft. When the drive gear rotates, the guide hole rotates at a reduced angular velocity as it approaches the loom, thereby allowing harnesses for warp threads which bind the coupling element to be moved across the orbital path for the monofilament without interference.

6 Claims, 8 Drawing Figures

APPARATUS FOR PRODUCING A WOVEN SLIDE FASTENER STRINGER

BACKGROUND OF THE INVENTION

1. Field of the Invention

The present invention relates to an apparatus for manufacturing a slide fastener stringer including a woven stringer tape and a coiled coupling element woven into the stringer tape along a longitudinal tape thereof.

2. Prior Art

Woven slide fastener stringers are manufactured by a loom for weaving a stringer tape and a rotor assembly for coiling a monofilament along a conical orbital path into a coiled coupling element as it is woven into the stringer tape along a longitudinal edge thereof. One known such apparatus is disclosed in U.S. Pat. No 3,941,163, issued Mar. 2, 1976. The loom includes two harness groups, one for warp threads making up a major tape portion and the other for binding warp threads for fastening the woven coupling element along the tape edge, the harness groups being spaced laterally away from each other such that the binding warp threads extend considerably obliquely with respect to the major warp threads. Resulting slide fastener stringers are structurally weak in that the binding warp threads undergo undue strain when interlaced with the weft thread.

SUMMARY OF THE INVENTION

A rotor having a guide hole for passage therethrough of an element-forming monofilament is rotatably mounted eccentrically on a stationary shaft alongside of a loom for weaving a slide fastener stringer tape while the monofilament is wound around a mandrel into a coiled coupling element as it is woven into the stringer tape. The rotor also has an axial pin slidably received in a radial slot in an arm rotatably mounted on the stationary shaft. A drive gear is rotatably mounted on the stationary shaft and drivingly connected to the arm. Accordingly, when the drive shaft rotates, the guide hole rotates at a varying angular velocity for enabling the monofilament to move along a conical orbital path at a reduced angular velocity adjacent to the loom. While the guide hole angularly moves at a reduced rate, harnesses for binding warp threads for securing the coiling coupling element to the stringer tape, move up and down into and out of the conical orbital path without interference with the monofilament being circled. The arm may be fastened by a screw to the drive gear, or operatively connected to the drive gear by a driven gear rotatably mounted eccentrically on the drive gear and held in driven mesh with a fixed gear mounted coaxially on the stationary shaft, the driven gear having an axial pin slidably received in another radial slot in the arm.

It is an object of the present invention to provide an apparatus for producing a woven slide fastener stringer, the apparatus including means for coiling an element-forming monofilament around a mandrel at different speeds to allow harnesses for binding warp threads to be moved up and down across an orbital path for the monofilament without interference therewith.

Another object of the present invention is to provide an apparatus for manufacturing a high-quality woven slide fastener stringer at an increased rate of production.

Many other advantages, features and additional objects of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 1:
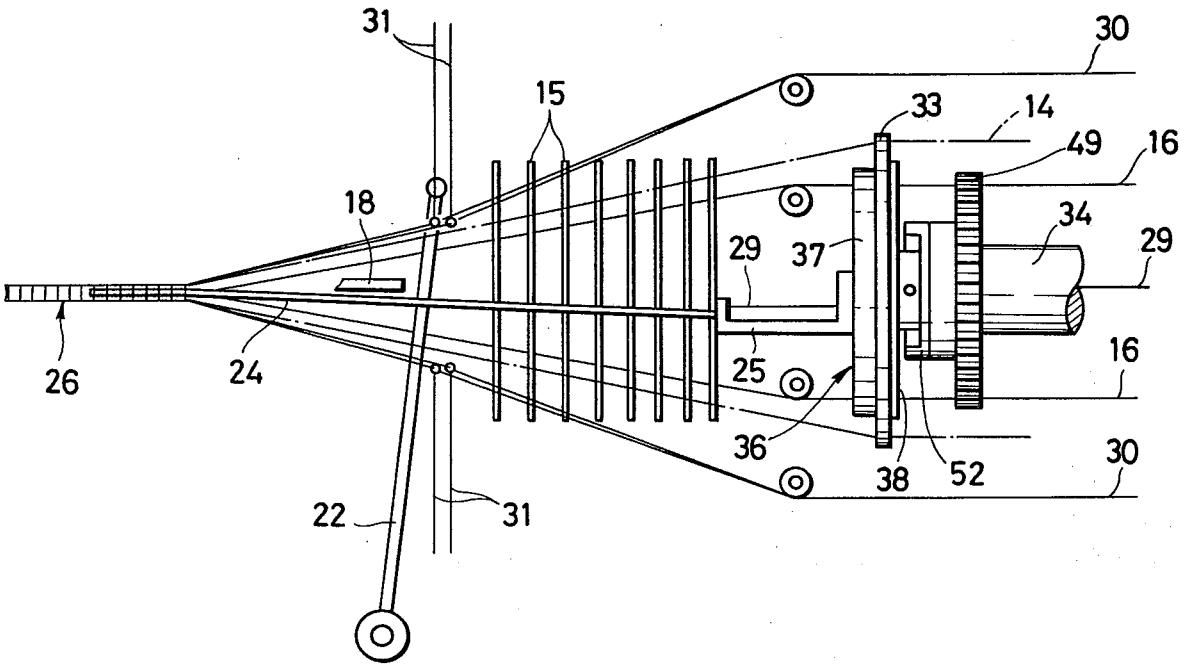
FIG. 1 is a schematic front elevational view of an apparatus according to the present invention.
Figure 2:
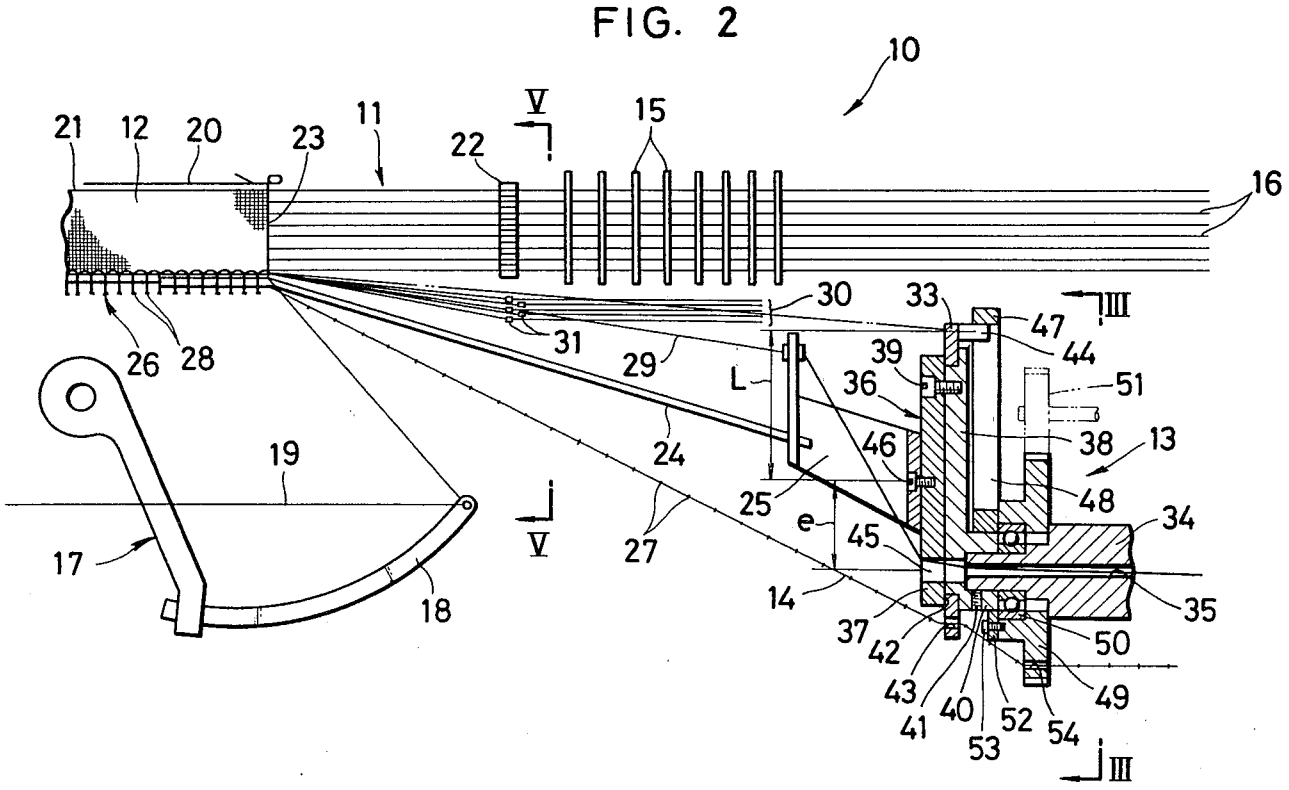
FIG. 2 is a plan view, with parts in cross section, of the apparatus shown in FIG. 1.

The principles of the present invention are particularly useful when embodied in an apparatus such as shown in FIGS. 1 and 2, generally indicated by the numeral 10.

The apparatus includes a needle loom 11 of a known construction for producing a narrow, continuous slide fastener stringer tape 12, and a rotor assembly 13 disposed adjacent to the needle loom 11 for winding an element-forming monofilament 14 into a helically coiled coupling element as it is woven into the stringer tape 12 along a longitudinal edge thereof.

The needle loom 11 comprises a group of harnesses 15 for forming sheds by raising and lowering warp threads 16 selectively, a weft inserter 17 having a filling carrier 18 for inserting a weft thread or filling 19 through the warp sheds, a latch needle 20 reciprocable in warp direction alongside of a longitudinal edge of the tape 12 for catching and knitting loops of the weft thread 19 carried by the filling carrier 18 so as to form a tape selvage 21 along the longitudinal tape edge, and a reed 22 for beating the weft thread 19 into the fell 23 of the tape 12 being woven.

The rotor assembly 13 includes a mandrel 24 mounted on a mandrel support 25 and around which the monofilament 14 can be wound or coiled into a slide fastener coupling element 26.

The monofilament 14 is made of plastic material and has a succession of widened, flattened portions 27 spaced at predetermined intervals therealong, such portions 27 being formed as by stamping. The widened, flattened portions 27 permit the monofilament 14 to be bent or folded over easily at such portions when the monofilament 14 is being coiled, and alternate widened, flattened portions 27 serve as coupling heads 28 of the element 26.

A reinforcing core thread 29 is fed along the mandrel 24 and inserted through the coupling element 26 as helically formed on the mandrel 24. Binding warp theads 30 are selectively raised and lowered by a group of harnesses 31, and are interlaced with the weft thread 19 and the helically coiled monofilament 14 for binding and securing the coupling element 26 to the stringer tape 12.

The rotor assembly 13 comprises a stationary shaft 34 supported immovably and nonrotatably by suitable means and having an axial hole 35 for passage therethrough of the core thread 29, and a circular guide disk 36 disposed eccentrically with respect to and extending substantially at a right angle to the stationary shaft 34. The guide disk 36 is composed of a pair of circular plates 37,38 secured together by a screw 39. The circular plate 38 includes a sleeve 40 fitted over a small-diameter end portion of the stationary shaft 34 and fixed thereto by a setscrew 41. The circular plates 37,38 jointly define an annular groove 42 opening radially outwardly and receiving an annular guide rotor 33 slidably rotatably around the guide disk 36. The guide rotor 33 has an axial guide hole 43 for passage therethrough of the monofilament 14 and an axial guide pin 44 that is located substantially in diametrically opposite relation to the guide hole 43.

The circular plates 37,38 jointly have an axial hole 45 in alignment with the axial hole 35 in the stationary shaft 34 for allowing the core thread 14 to pass through the guide disk 36. The mandrel support 25 is fixedly mounted on the circular plate 37 by a screw 46.

A radial arm 47 is mounted on the sleeve 40 for rotation therearound. The radial arm 47 has a radial slot 48 in which the guide pin 44 is slidably received. A drive gear 49 is rotatably mounted by a bearing 50 on the stationary shaft 34, and is drivable by a motor gear 51 held in mesh therewith. The radial arm 47 includes a flange 52 secured by a screw 53 to the drive gear 49, whereby the radial arm 47 can revolve with the drive gear 49 around the stationary shaft 34 upon rotation of the motor gear 51. The drive gear 49 has an axial guide hole 54 for passage therethrough of the monofilament 14.

Figure 3A:
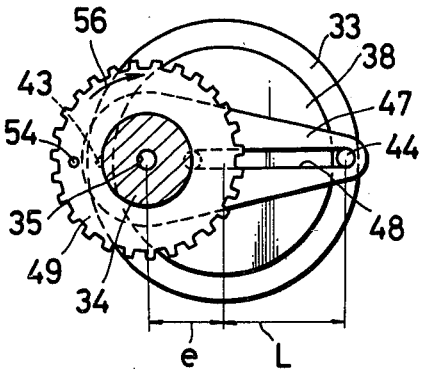
FIGS. 3A through 3D are cross-sectional views taken along line III—III of FIG. 2, illustrating successive angular positions of parts as a drive gear rotates through increments of 90 degrees.

Operation of the apparatus 10 is as follows. FIGS. 2 and 3A illustrate a starting position in which the guide hole 43 in the guide rotor 33 is located farthest from the warp threads 16 and the guide pin 44 is located closest to the warp threads 16. When the drive gear 49 is angularly moved clockwise in the direction of the arrow 56 through 90 degrees from the position of FIGS. 3A to that of FIG. 3B, the arm 47 is also angularly moved with the drive gear 49 through 90 degrees with the guide pin 44 as slidably guided in the slot 48 being angularly displaced through more than 90 degrees due to the eccentricity of the guide rotor 33 with respect to the stationary shaft 34. The guide hole 43 is therefore angularly moved through a corresponding angle of $\alpha$ which is approximately 129 degrees in the illustrated embodiment.

Figure 3B:
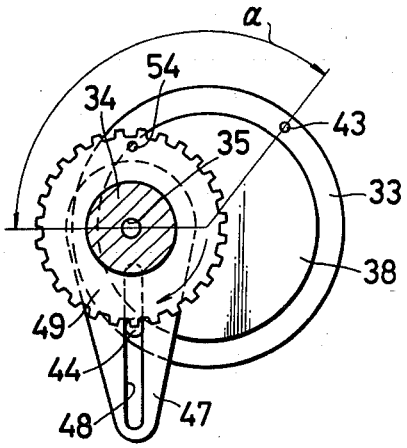
Figure 3C:
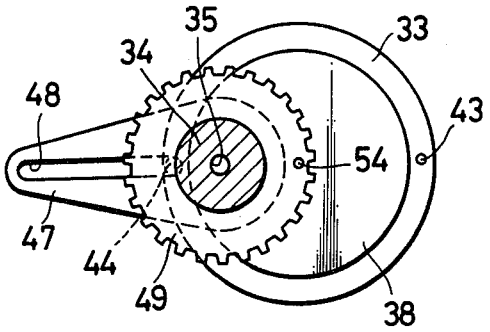
Figure 3D:
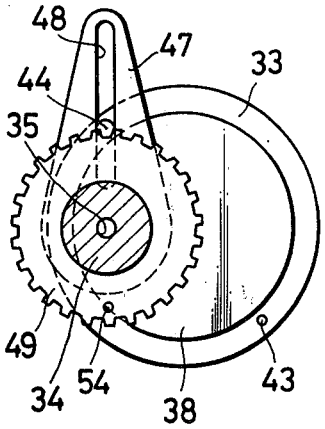

At the drive shaft 49 continues to be angularly moved clockwise through another angle of 90 degrees to the position shown in FIG. 3*c*, the guide rotor 33 is angularly moved through approximately 51 degrees, whereupon the guide hole 43 is located closest to the warp threads 16. Continued angular movement of the drive gear 49 through 90 degrees causes the guide hole 43 to be angularly displaced through about 51 degrees as illustrated in FIG. 3D. The guide hole 43 is further angularly moved through about 129 degrees from the position of FIG. 3D back to the starting position of FIG. 3A by continued 90-degree angular movement of the drive gear 49.

Accordingly, while the drive gear 49 angularly moves through 180 degrees from the position of FIG. 3B to the position of FIG. 3D, the guide hole 43 angularly moves through only about 102 degrees, that is, it moves at a lower speed of rotation than that of the drive gear 49. During the angular movement of the drive gear 49 through the subsequent 180 degrees from the position of FIG. 3D to the position of FIG. 3B, the guide hole 43 angularly moves through about 258 degrees, that is, it moves at a speed of rotation higher than that of the drive gear 49.

Figure 4:
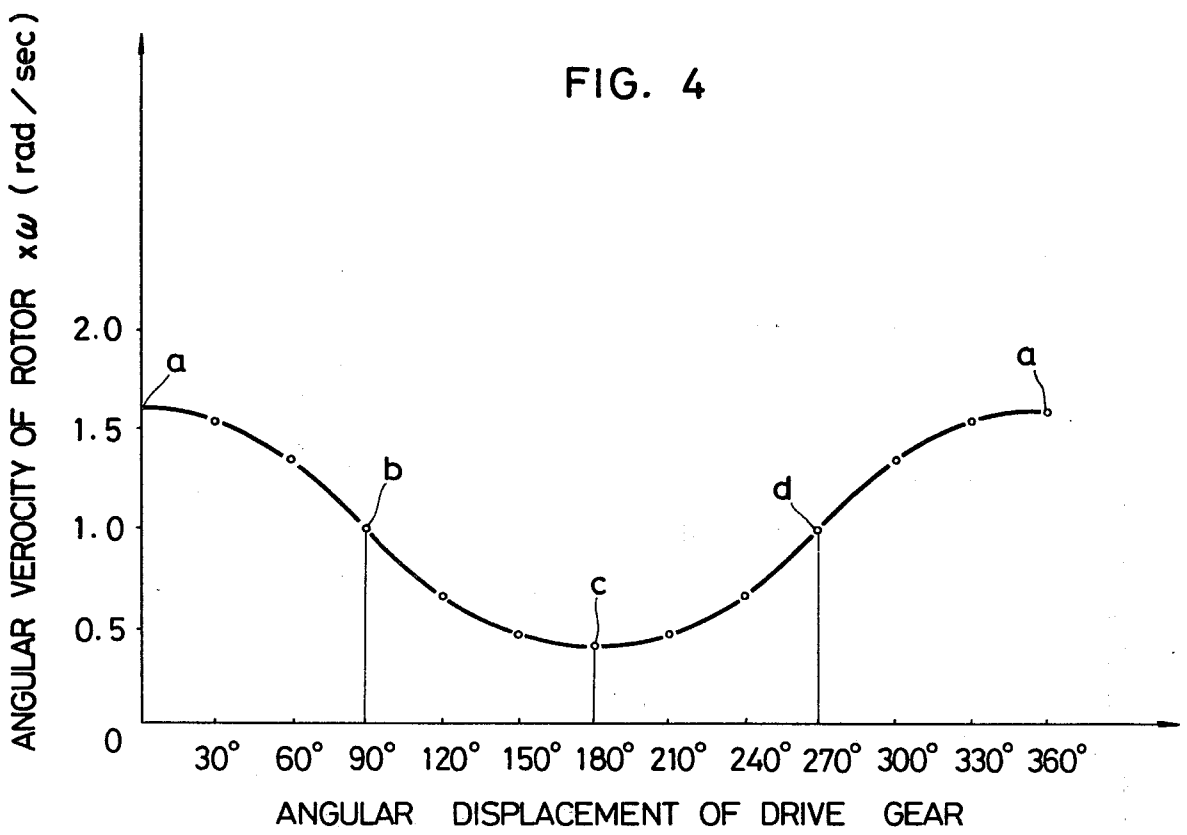
FIG. 4 is a diagram showing the varying angular velocity of a rotor.

FIG. 4 is a diagram of the angular velocity of the rotor 33 which varies during one cycle of revolution as a function of angular displacement of the drive gear 49, it being assumed that the amount of eccentricity of the guide disk 36 with respect to the stationary shaft 34 is 12 mm, the distance between the axis of rotation of the rotor 33 and the central axis of the pin 44 is 20 mm, and the drive gear 49 is rotated at a constant angular velocity $\omega$ (rad/sec). The angular velocities of the rotor 33 at the respective positions shown in FIGS. 3A through 3D correspond to the points a through d, respectively, on the curve illustrated in FIG. 4.

Figure 5A:
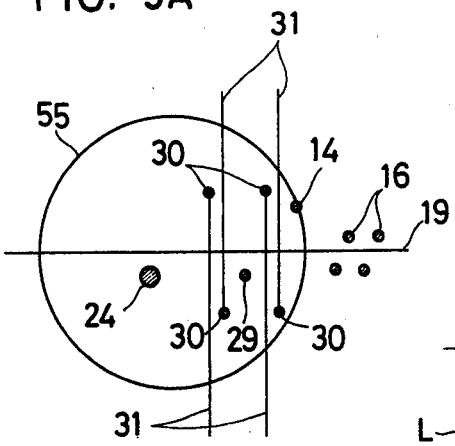
FIGS. 5A and 5B are schematic cross-sectional views taken along line V—V of FIG. 2, showing successive angular position parts as the drive gear rotates through 180 degrees.
Figure 5B:
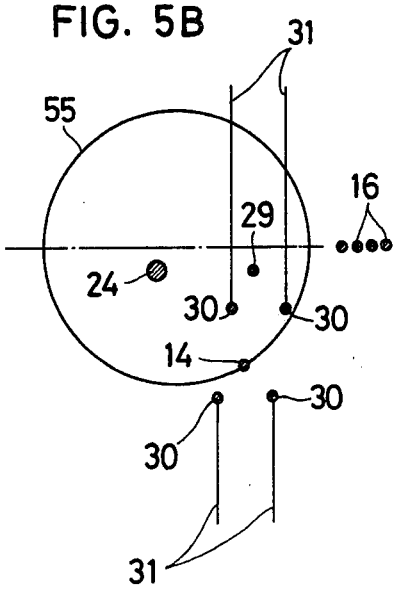

As shown in FIGS. 5A and 5B, the harnesses 31 for the binding warp threads 30 are located off center with respect to a conical orbital path 55 for the monofilament 14 and as closely to the warp threads 16 as possible to maintain the binding warp threads 30 substantially parallel to the warp threads 16. The guide hole 43 and hence the monofilament 14 carried therein are relatively slow in their angular movement adjacent to the warp threads 16 during a half cycle of revolution of the drive gear 49, so that the harnesses 31 can be moved up and down across the conical orbital path 55 reliably without hitting the monofilament 14 being circled. As the drive gear 49 moves through another half cycle of revolution, the monofilament 14 angularly moves relatively rapidly through a portion of the conical orbital path 55 which is remote from the binding warp threads 30, and hence is free from interference with the harnesses 31. The speed of revolution of the drive gear 49 can therefore be increased as a whole for a larger rate of production of a slide fastener stringer inasmuch as the monofilament 14 moves adjacent to the warp threads 16 slowly enough to allow reliable operation of the harnesses 31.

The tangential velocity V of the pin 44 on the rotor 33 can be determined by the formula:

$$V = \frac{\omega L\left(e\cos\theta + \sqrt{e^2\cos^2\theta + L^2 - e^2}\right)}{\sqrt{L^2 - e^2\sin^2\theta}}$$

where $\omega$ = angular velocity of the drive gear 49 (rad/sec),

L = distance between the rotational axis of the rotor 33 and the central axis of the pin, e = amount of eccentricity of the guide disk 36 with respect to the shaft 34, and $\theta$ = angular displacement of the arm 47.

The speed of rotation of the guide hole 43 can thus be adjusted by selecting the distance L and the amount e of eccentricity. Stated otherwise, the interval of time in which the guide hole 43 moves angularly from the position of FIG. 3B to the position of FIG. 3D can be varied by changing these parameters L and e.

Figure 6:
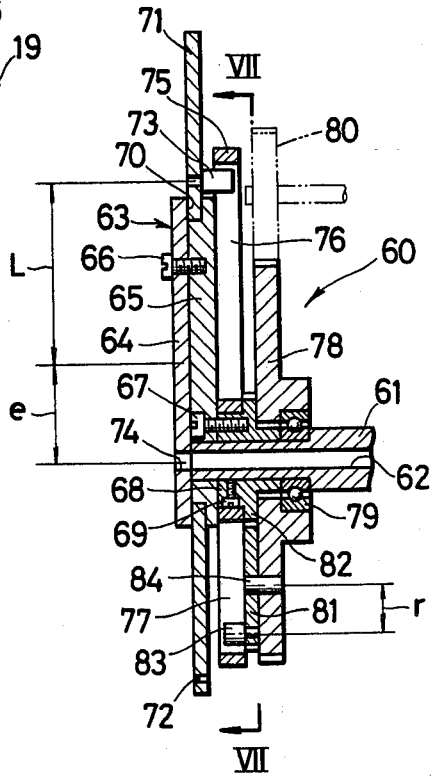
FIG. 6 is a cross-sectional view of a portion of an apparatus according to a second embodiment of the present invention.
Figure 7A:
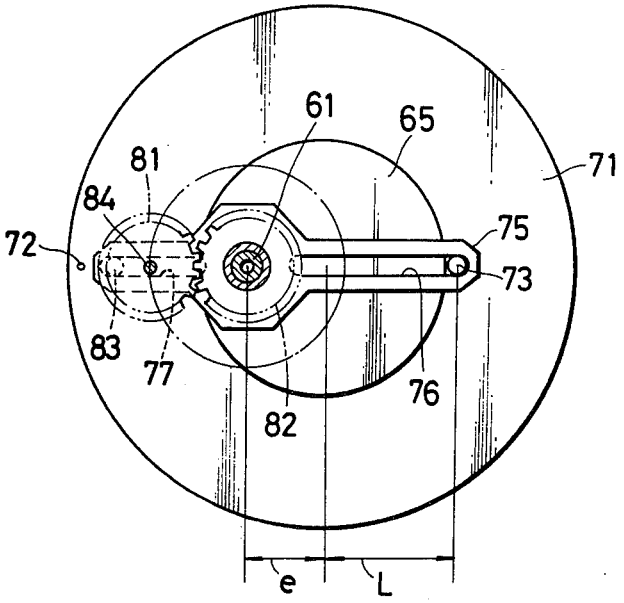
FIGS. 7A through 7D are cross-sectional views taken along line VII—VII of FIG. 6, illustrating successive positions of parts as a drive gear rotates through increments of 90 degrees.
Figure 7B:
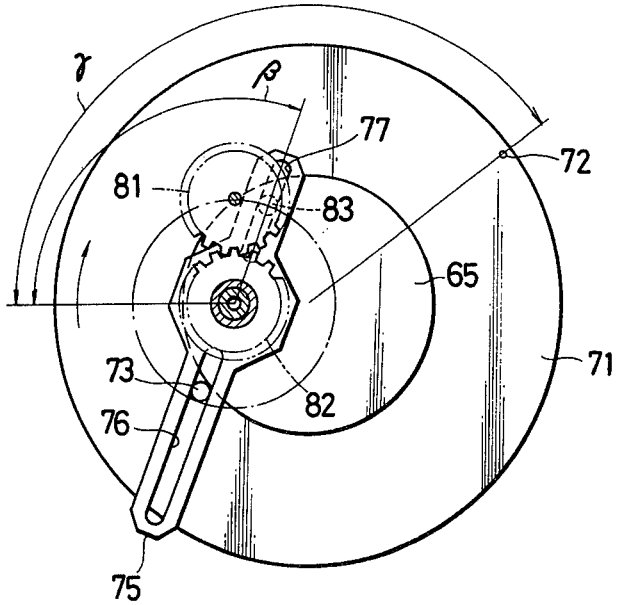

According to another embodiment of the present invention, a rotor assembly 60 as shown in FIGS. 6 and 7A–7B comprises a stationary shaft 61 having a central axial hole 62 for passage therethrough of the monofilament 14, and a circular guide disk 63 attached eccentrically to the stationary shaft 61 lying in a plane extending at a right angle to the shaft 61. The guide disk 63 comprises a pair of circular plates 64,65 fixed together by a screw 66, the circular plate 65 being secured by a screw 67 to a sleeve 68 fitted over a small-diameter end portion of the stationary shaft 61. The sleeve 68 is nonrotatably fixed to the shaft 61 by a radially extending setscrew 69.

An annular groove 70 is defined jointly by and between the circular plates 64,65, and an annular guide rotor 71 is rotatably received in the annular groove 70. The rotor 71 has an axial guide hole 72 and an axial pin 73 which are diametrically opposite to or angularly spaced 180 degrees from each other. The circular plate 64 has a hole 74 axially aligned for communication with the axial hole 62 for passage therethrough of the core thread 29. An arm 75 rotatably mounted on the sleeve 68 has a pair of diametrically opposite radial slots 76,77, the axial pins 73 on the rotor 71 being slidably received in the radial slot 76. A drive gear 78 is rotatably supported by a bearing 79 on the stationary shaft 61 and is held in mesh with a gear 80 drivable by a motor (not shown). The drive gear 78 supports an eccentric gear 81 mounted thereon as a planetary gear by a pin 84 and meshing with a fixed gear 82 that is integral with the sleeve 68 and coaxial with the stationary shaft 61, the gears 81,82 having the same dimensions. The eccentric gear 81 has an axial off-center pin 83 slidably received in the radial slot 77 in the arm 75 thus forming a pin-and-slot connection therebetween.

The drive gear 78 is rotated to enable the eccentric gear 81 to revolve therewith around the stationary shaft 61 and at the same time to rotate about the pin 84 by meshing engagement with the fixed gear 82. The rotor 71 now starts rotating clockwise from the position of FIG. 7A. As the drive gear 78 angularly moves through 90 degrees, the arm 75 angularly moves through an angle of $\beta$ (FIG. 7B) which is greater than 90 degrees because the gear 81 is turned about the pin 84 to advance the arm 75 angularly ahead of the drive gear 78 through angular displacement of the pin 83. Simultaneously, the rotor 71 and hence the guide hole 72 therein are angularly moved through an angle of $\gamma$ which is much greater than the angle $\beta$ because of the pin 73, trapped radially movably in the radial slot 76, being angularly moved. The angle $\gamma$ is approximately 142.5 degrees in the illustrated embodiment. The drive gear 78 continues to move angularly through another 90 degrees, whereupon the arm 75 is angularly moved through 180 degrees from the starting position. At this time, the guide hole 72 is angularly moved through approximately 37.5 degrees from the position of FIG. 7B to the position of FIG. 7C wherein the guide hole 72 is located closest to the warp threads 16. Continued angular movement of the drive gear 78 through 90 degrees causes the guide hole 72 to angularly move through about 37.5 degrees to the position illustrated in FIG. 7D. The guide hole 72 is continuously angularly moved through about 142.5 degrees from the position of FIG. 7D to the starting position of FIG. 7A, whereupon one cycle of operation is completed.

Figure 7C:
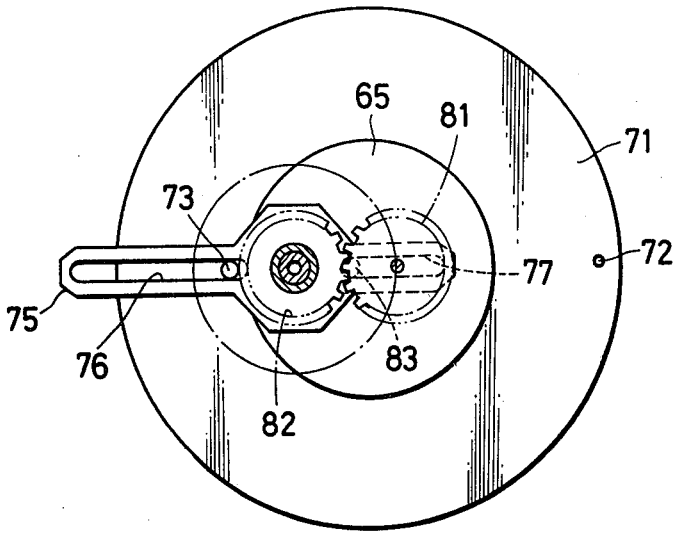
Figure 7D:
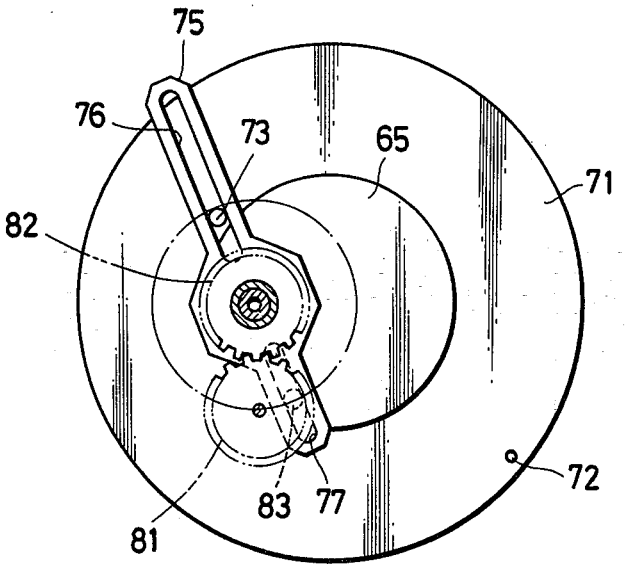

During the 180-degree angular movement of the drive gear 78 from the position of FIG. 7B through the position of FIG. 7C to the position of FIG. 7D, the guide hole 72 angularly moves only through about 75 degrees and hence at a low speed of rotation. While the drive gear 78 is angularly moved from the position of FIG. 7D through the position of FIG. 7A to the position of FIG. 7B, the guide hole 72 angularly moves through about 285 degrees and hence at a high speed of rotation.

The tangential velocity of the pin 73 and hence the speed of rotation of the guide hole 72 can be adjusted by changing the distance L between the rotational axis of the rotor 71 and the central axis of the pin 73, the amount e of eccentricity of the guide disk 63 with respect to the shaft 61, and the amount r of eccentricity of the pin 83 with respect to the pin 84 of the gear 81. Accordingly, the interval of time in which the guide hole 72 moves from the position of FIG. 7B to the position of FIG. 7D can be varied by changing the parameters L, e and r.

Figure 8:
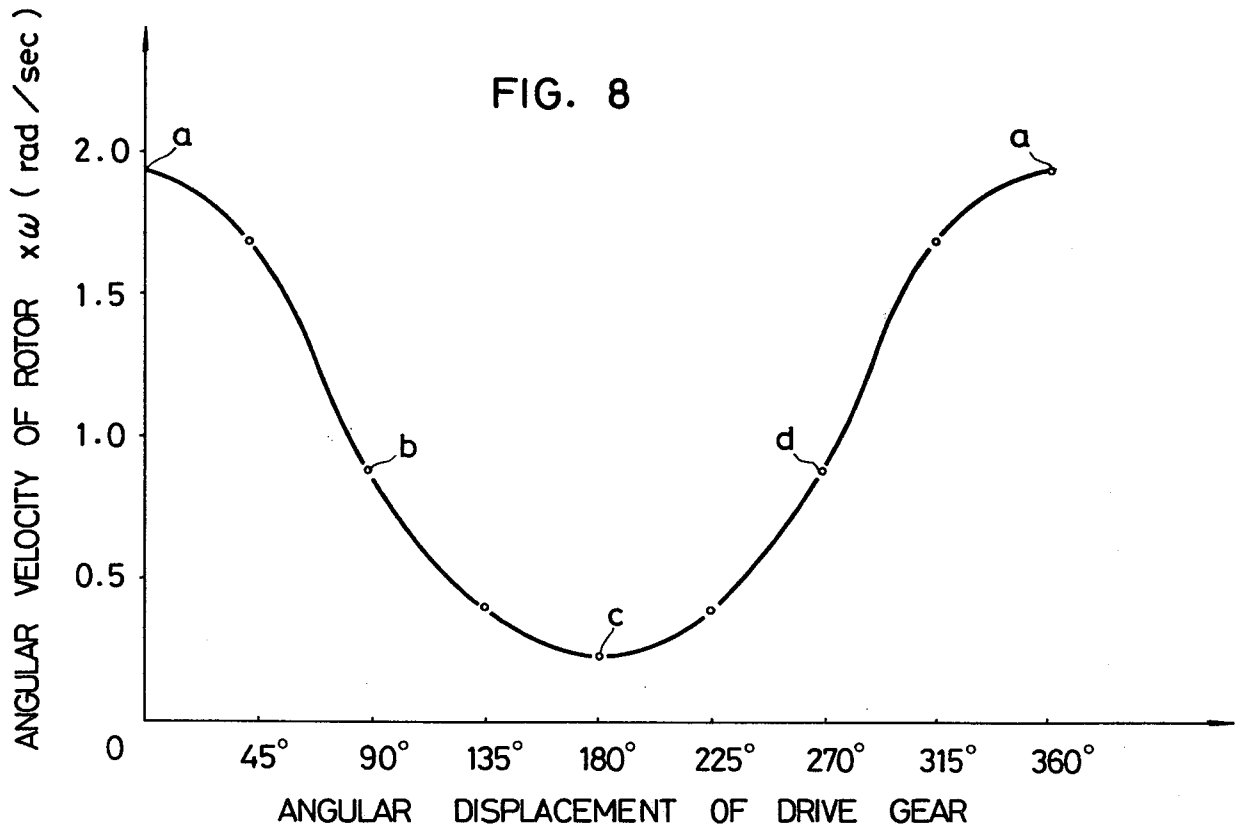
FIG. 8 is a diagram showing the varying angular velocity of a rotor according to the second embodiment.

Assuming that the amounts e and r of eccentricity are 16 mm and 8 mm, respectively, the fixed gear 82 has a radius of 12 mm, the distance L is 29 mm, and the drive gear 78 is rotated at a constant angular velocity $\omega$ (rad/sec), the angular velocity of the rotor 71 changes as a function of the angular displacement of the drive gear 78 as illustrated in FIG. 8. The points a through d on the curve of FIG. 8 correspond to the positions of FIGS. 7A through 7D, respectively.

The rotor 71 according to the embodiment shown in FIG. 6 angularly moves more rapidly during the interval between the FIG. 7B and FIG. 7D positions than the rotor 33 of the embodiment shown in FIG. 2 angularly moves from the FIG. 3B to the FIG. 3D position.

Although various minor modifications may be suggested by those versed in the art, it should be understood that I wish to embody within the scope of the patent warranted hereon, all such embodiments as reasonably and properly come within the scope of my contribution to the art.

The adjective "axial" as used herein refers to a direction, and does not mean "coaxial".

I claim as my invention:

1. An apparatus for manufacturing a slide fastener stringer including a woven stringer tape and a coiled coupling element woven into the stringer tape along a longitudinal edge thereof, said apparatus comprising:

(a) means for weaving the stringer tape of warp and weft threads, said means including harnesses for binding warp threads extending adjacent to said warp threads;

(b) a mandrel for extending at an angle to the warp threads;

(c) a stationary shaft;

(d) a rotor rotatably mounted on said stationary shaft in eccentric relation and having an axial guide hole for passage therethrough of a monofilament for being wound around said mandrel in an orbital path to form the coiled coupling element, for being then woven into the stringer tape by the weft thread, said rotor having an axial pin;

(e) an arm rotatably mounted on said shaft and having a radial slot in which said axial pin is slidably received;

(f) a drive gear rotatably mounted on said shaft and drivingly connected to said arm, whereby said guide hole is rotatable about the axis of said rotor at a varying angular velocity in response to rotation of said drive gear to allow said harnesses to move across said orbital path without interference with the monofilament being wound.

2. An apparatus according to claim 1, including a fastener by which said arm is secured to said drive gear for corotation.

3. An apparatus according to claim 1, said axial hole and said axial pin being angularly spaced 180 degrees from each other.

4. An apparatus according to claim 1, including means acting between said arm and said drive gear for angularly displacing said arm with respect to said drive gear upon rotation thereof.

5. An apparatus according to claim 4, said angularly displacing means comprising a fixed gear coaxially mounted on said stationary shaft, and a driven gear rotatably mounted on said drive gear in eccentric relation and held in driven mesh with said fixed gear, said driven gear having an eccentric axial pin, said arm having another radial slot extending diametrically opposite with respect to said first-mentioned radial slot, and said last-mentioned axial pin being slidably received in said another radial slot.

6. An apparatus according to claim 4, said angularly displacing means including a fixed gear coaxially carried on said stationary shaft, and a planetary gear rotatably carried on said drive gear in mesh with said fixed gear, and having a pin-and-slot connection with said arm.

* * * * *